United States Patent [19]

Ibrahim et al.

[11] Patent Number: 5,057,188

[45] Date of Patent: Oct. 15, 1991

[54] SLICE CLEANING APPARATUS HAVING BIAS MEANS

[75] Inventors: Ahmed A. Ibrahim, Westerville; Juan H. Crawford, Grove City, both of Ohio

[73] Assignee: Papyrus, Inc., Westerville, Ohio

[21] Appl. No.: 683,696

[22] Filed: Apr. 11, 1991

[51] Int. Cl.[5] ..... D21F 1/00; D21F 11/00

[52] U.S. Cl. ..... 162/199; 162/272; 162/344; 15/246

[58] Field of Search ..... 162/272, 199, 344, 336; 15/246

[56] References Cited

U.S. PATENT DOCUMENTS 5,011,576 4/1991 Egelhof ..... 162/344

*Primary Examiner*—Richard V. Fisher
*Assistant Examiner*—Brenda Lamb
*Attorney, Agent, or Firm*—Frank H. Foster

[57] ABSTRACT

The invention is a cleaning means used to clean a slice in a paper manufacturing machine. The slice cleaning means is made up of a scraping body, a bias means which is attached at one end to the scraping body, and a foot which is attached to the opposite end of the bias means. The scraping body matingly conforms to the outer surface of the upper plate of the slice, and the foot rests on the lower plate of the slice. The slice cleaning means is driven laterally along the slice to remove foreign particles.

16 Claims, 7 Drawing Sheets

SLICE CLEANING APPARATUS HAVING BIAS MEANS

TECHNICAL FIELD

This invention relates to the field of paper manufacturing machines, and more specifically to a means for cleaning a slice in a paper manufacturing machine. The slice is typically made up of an upper and a lower lip between which a suspension of paper fibers and other materials in water flows.

BACKGROUND ART

In a paper manufacturing machine, a suspension of paper fibers and other materials in water flows out of a horizontal slot in the paper manufacturing machine onto a foraminous screen conveyor. The fibers in this water suspension will form the paper product once the water is removed from it. The horizontal slot out of which the fiber suspension flows, is called the slice. The slice is typically made up of a lower plate which is generally parallel to the conveyor and a sharp-edged upper plate having a height and angle relative to the lower plate which are adjustable. The upper plate is usually generally perpendicular to the lower plate. The slice defining surface of the upper and lower plates are referred to in more general terms as the upper lip and the lower lip.

As the fiber suspension flows between the upper and lower lips, paper fibers or other materials may become lodged on the front or back side of the upper lip and agglomerate into small clumps. When this occurs, the fiber suspension flowing through the slice past these clumps flows irregularly. This irregular flow of the suspension causes streaks or irregularities in the final paper product which are considered to be defects. Therefore, it is desirable to periodically remove the clumps from the slice.

The width of the slice may be as much as 30 feet or more and because of the inaccessibility of the entirety of this wide slot, the removal of clumps of fibers is very difficult. The conventional way of removing clumps of fibers is to completely shut down the machine and either treat the slice with chemicals or scrape it with a tiny plastic scraper. Since the conventional cleaning means requires completely shutting down the machine, the conventional way of cleaning the slice is expensive and difficult to do and therefore it is rarely done.

There is a need for a slice cleaning means which is quick and effective, alleviating the problem of total shut down which results in high costs.

BRIEF DISCLOSURE OF INVENTION

This invention is for use in a paper manufacturing machine. Paper manufacturing machines typically comprise a slice having, in an operable position, an upper lip and a lower lip between which a suspension of paper fibers and other materials in water flows. The invention is an improved slice cleaning means which comprises a scraping body, which matingly conforms to at least a portion of the upper lip of the slice, and a foot which seats against the lower lip of the slice. The invention further comprises a bias means which connects the scraping body with the foot and urges the scraping body against the upper lip.

Figure 1:
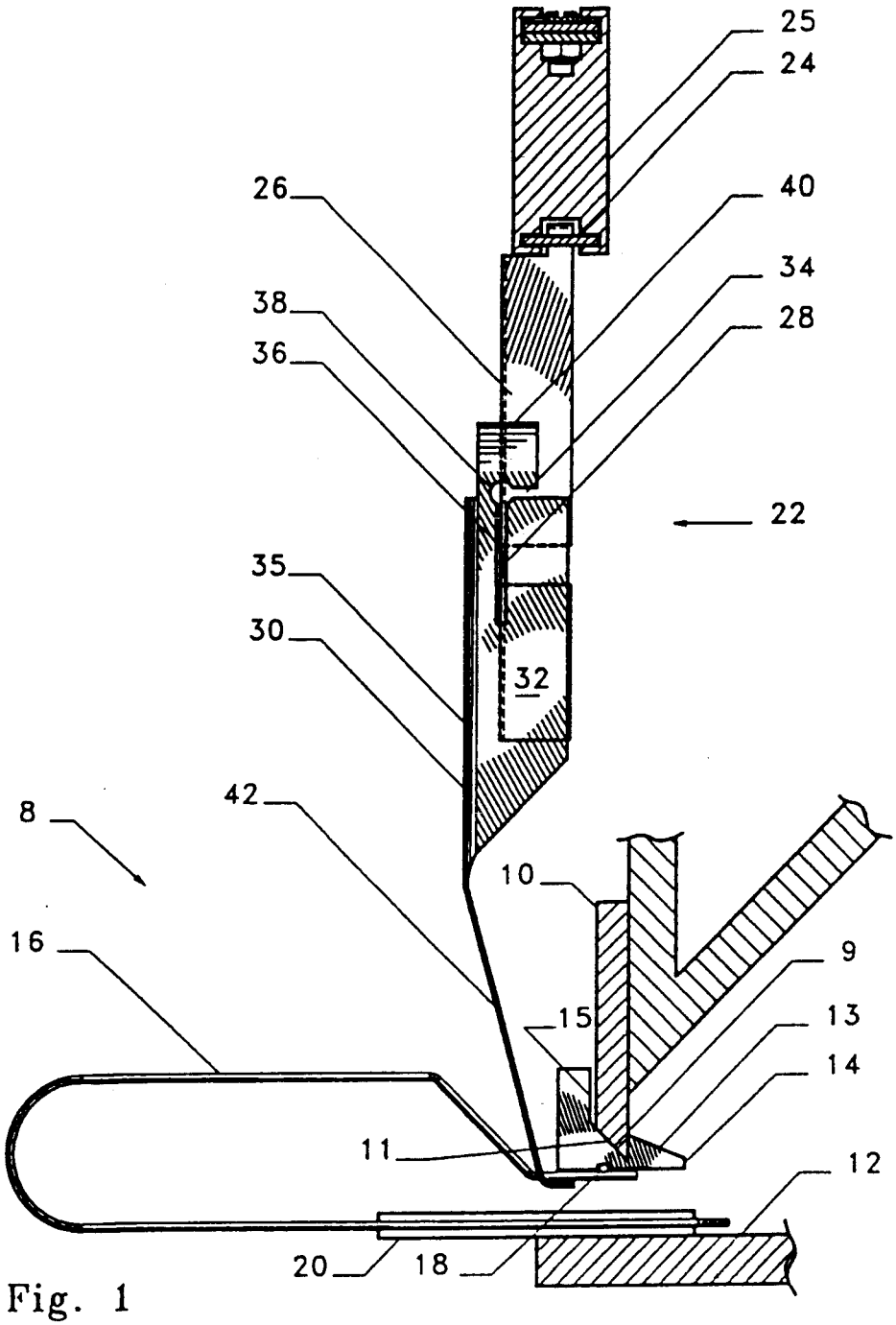
FIG. 1 is a side view illustrating the preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Figure 2:
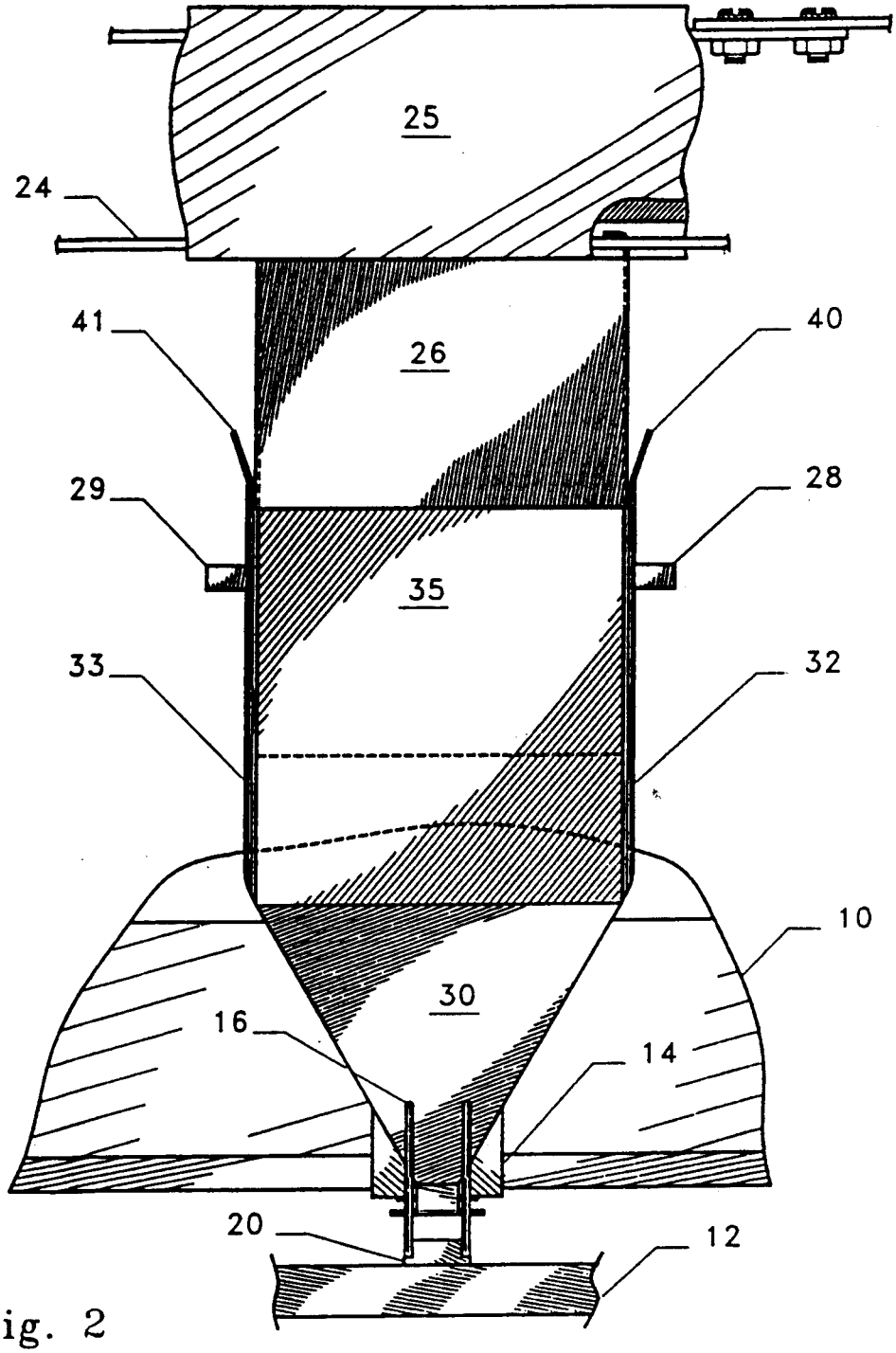
FIG. 2 is a front view illustrating the preferred embodiment of the present invention.

FIGS. 1 and 2 show the preferred embodiment of the present invention in its operative position. A slice cleaning apparatus 8, shown in FIG. 1, is inserted within the slice which consists of an upper lip 9 formed on the lower edge of an upper plate 10 and a lower lip 12. The cleaning apparatus 8 includes a scraping body 14 which is attached to a spring 16 and is biased against the upper lip 9. The scraping body 14 is preferably a corrosion resistant, low friction polymer, shaped to conform to the outer surface of the upper lip 9. The scraping body 14 is preferably shaped to have an inclined edge 13 and a stop edge 15 separated by a surface 11 which conforms to a portion of the outer surface of the upper lip 9. The scraping body 14 is attached to a spring 16 by a rocker 18 which allows limited, three-dimensional movement of the scraping body 14 relative to the spring 16. This freedom to move allows the scraping body 14 to rock and pivot so that it conforms precisely to the upper lip 9, even if the angle or height of the upper lip 9 changes over the length of the slice. The spring 16 is generally U-shaped with the scraping body 14 attached to one leg of the "U" and a foot 20 rigidly attached to the other leg. The foot 20 is preferably made of a similar corrosion resistant, low friction polymer as the scraping body 14. The foot 20 is supported by and presses against the lower lip 12 in its operable position in FIG. 1.

Typically the outer surface of the upper sharp-edged plate 10 is made up of a series of interconnected planes or segments. When looking at its cross-section as illustrated in FIG. 1, the upper sharp-edged plate 10 has two parallel side planes and a lower plane which forms an obtuse angle with the left side plane and an acute angle with the right side plane. The right side plane extends lower than the left side plane. Therefore the three segments which comprise the "outer surface" of the upper sharp-edged plate are the right side plane, the left side plane, and the lower plane. There are, however, other configurations in use.

The slice cleaning apparatus 8 is preferably driven laterally across the slice opening, perpendicularly to the plane of FIG. 1. A drive apparatus 22 is attached to the cleaning apparatus 8 in the preferred embodiment to accomplish this. The preferred drive apparatus 22 is made up of a closed loop transmission belt 24 which slides inside of a track 25 and which may be driven, for example, by a sprocket on an electric motor or any other suitable drive mechanism. The transmission belt 24 is secured to a carriage 26 which extends downward from the transmission belt 24 in FIG. 1. The carriage 26 has a pair of ears 28 and 29 (ear 29 not visible in FIG. 1) which extend outwardly, laterally from the carriage 26.

The carriage 26 attaches to the cleaning apparatus 8 by an intermediate linking body 30 which has two side panels 32 and 33 (side panel 33 not visible in FIG. 1) that are transverse to the plane of a front panel 35 of the linking body 30. Each of these side panels 32 and 3 has two slots formed in it. Side panel 32 has a primary slot 34 which is transverse to and connected to a secondary slot 36 at a circular enlargement 38, which has a diameter that is equal to or greater than the width of the ear 28. Side panel 33 has identical slots and circular enlargement. The side panels 32 and 33 additionally have tabs 40 and 41 (tab 41 not visible in FIG. 1) which extend upwardly and outwardly from the planes of the side panels 32 and 33.

Linking body 30 has a downwardly extending neck 42 which attaches to the spring 16 just leftward of the scraping body 14 in FIG. 1. The neck 42 attaches pivotally to the spring 16, allowing hinging motion of the spring 16 relative to the neck 42.

The installation and operation of the cleaning apparatus 8 and the drive apparatus 22 is as follows. The linking body 30 is held outward of and generally perpendicular to the carriage 26. The linking body 30 is then moved horizontally toward the carriage 26. The tabs 40 and 41 tend to guide the linking body 30 into alignment with the carriage 26. When the linking body 30 contacts the carriage 26, the primary slots, which are located on the side panels 32 and 33, are directly above the ears 28 and 29. Downward sliding of the linking body 30 will cause the ears 28 and 29 to be inserted into the slots in the side panels 32 and 33. As the ear 28, for example, is slid into the slot 34 and reaches the circular enlargement 38, the linking body 30 is pivoted 90° around the ear 28 (and the ear 29 on the opposite side) to a vertical orientation which is generally parallel to the carriage 26. The spring 16 is then compressed by hand and the inclined edge 13 of the scraping body 14 is inserted under the upper lip 10 and the foot 20 is slid over the lower lip 12. This insertion of the scraping body 14 between that upper lip lo and lower lip 12 continues until the scraping body 14 reaches the position where the surface 11 of the scraping body 14 matches the outer surface of the upper lip 10. At this point, the scraping body 14 snaps upward, under the bias of the spring 16, and seats against the upper lip 10.

The stop edge 15 of the scraping body 14 is provided to prevent the person inserting the cleaning apparatus 8 from inserting it too far into the slice. The stop edge 15 is generally parallel with the upper lip 10 and, when the scraping body 14 is in its preferred position relative to the upper lip 10, the stop edge 15 is approximately 1/16th of an inch from the parallel edge of the upper lip 10. The entire apparatus is then driven laterally by operation of the drive apparatus 22. The slice cleaning apparatus 8 is typically inserted at one end of the slice, driven to the opposite side, and then returned to the side of insertion where it is removed by reversing the above process.

FIG. 2, which is a front view of the embodiment illustrated in FIG. 1, more easily illustrates the purpose of the tabs 40 and 41. At the first stage of installing the cleaning apparatus 8, as the linking body 30 approaches and is generally perpendicular to the carriage 26, the tabs 40 and 41 are placed beside the lateral edges of the carriage 26. These tabs guide and eventually align the slots on the linking body 30 with the ears 28 and 29 on the carriage 26. This guiding and alignment assures that a downward sliding of the linking body 30 will insert the ears 28 and 29 into the slots in the side panels 32 and 33.

The long slot 36 in the side panel 32 of the linking body 30 in FIG. 1, allows free up and down motion of the linking body 30 during compression of the spring 16 and during lateral sliding of the cleaning apparatus 8 along the slice. Because the slice opening, that is the distance between the lower edge of the upper lip 10 and the upper edge of the lower lip 12, is variable, the slot 36 is created longer than is necessary at most upper lip heights (as is its identical slot on the side panel 33) to allow for the adjustable height of the slice and any slight variation in height which can be expected across the width of the slice.

FIGS. 3 through 7 illustrate an alternative embodiment, suitable for larger paper machines.

Figure 3:
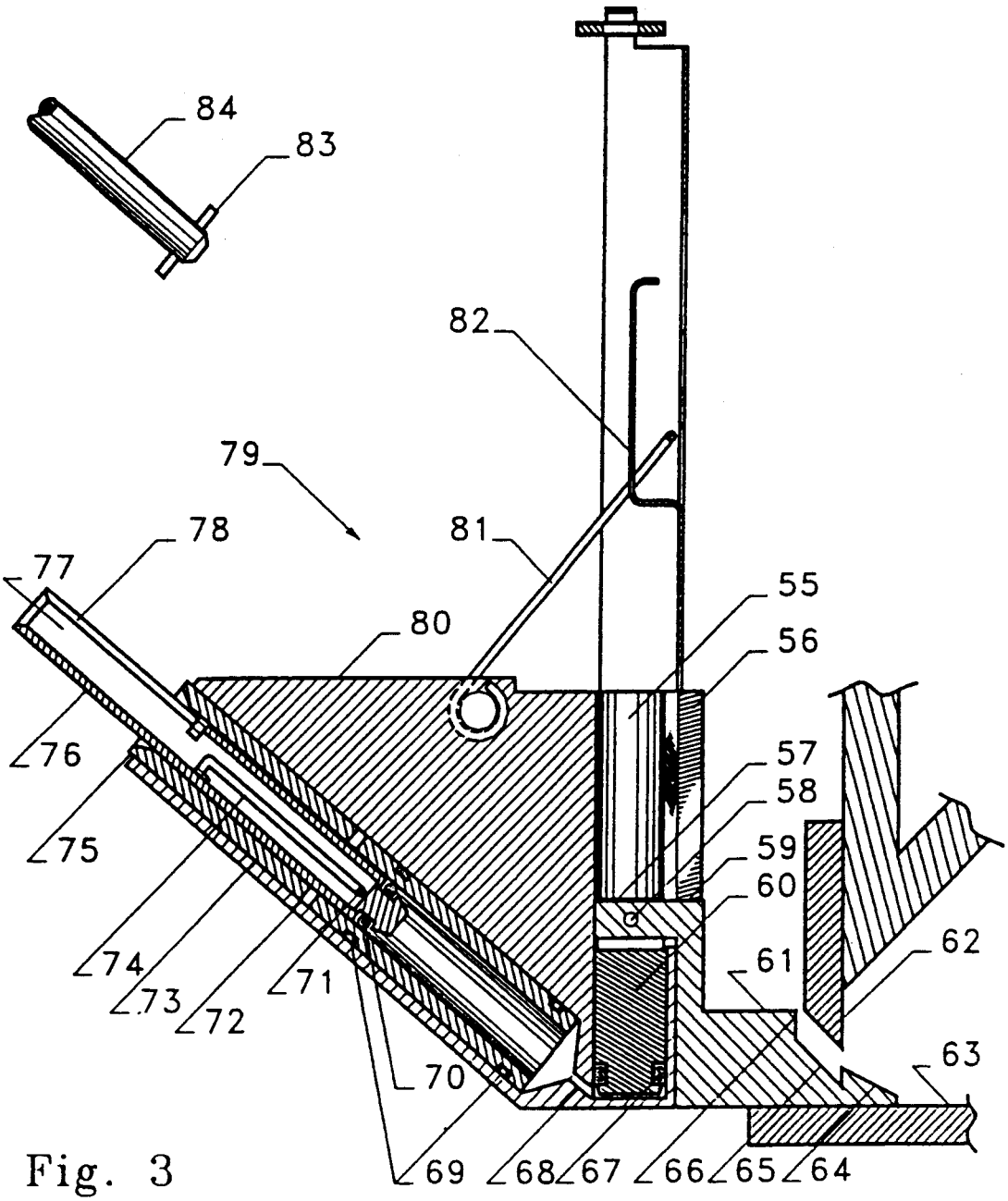
FIG. 3 is a view in section illustrating an alternative embodiment of the present invention.
Figure 4:
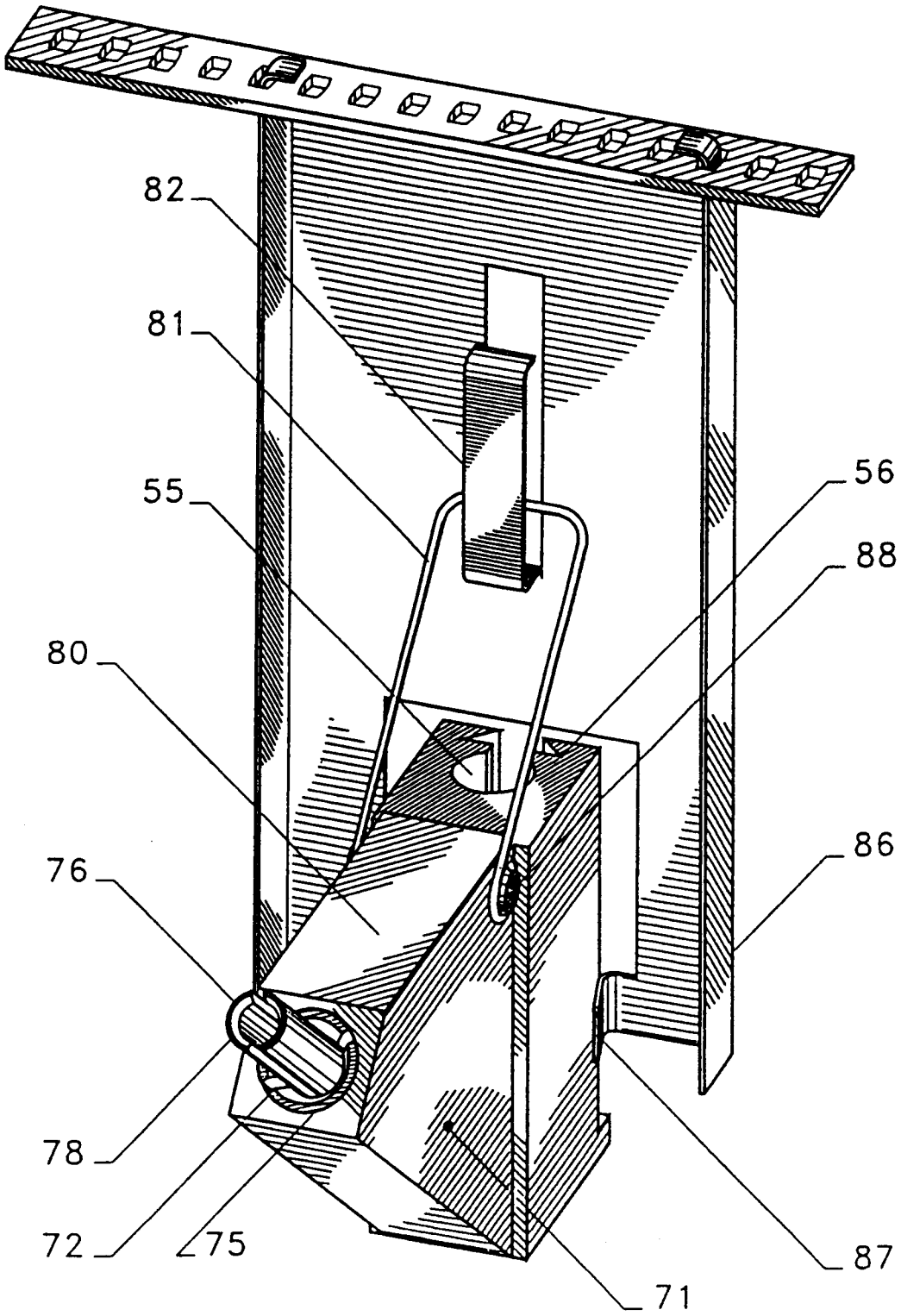
FIGS. 4 and 5 are views in perspective of the embodiment of FIG. 3.
Figure 5:
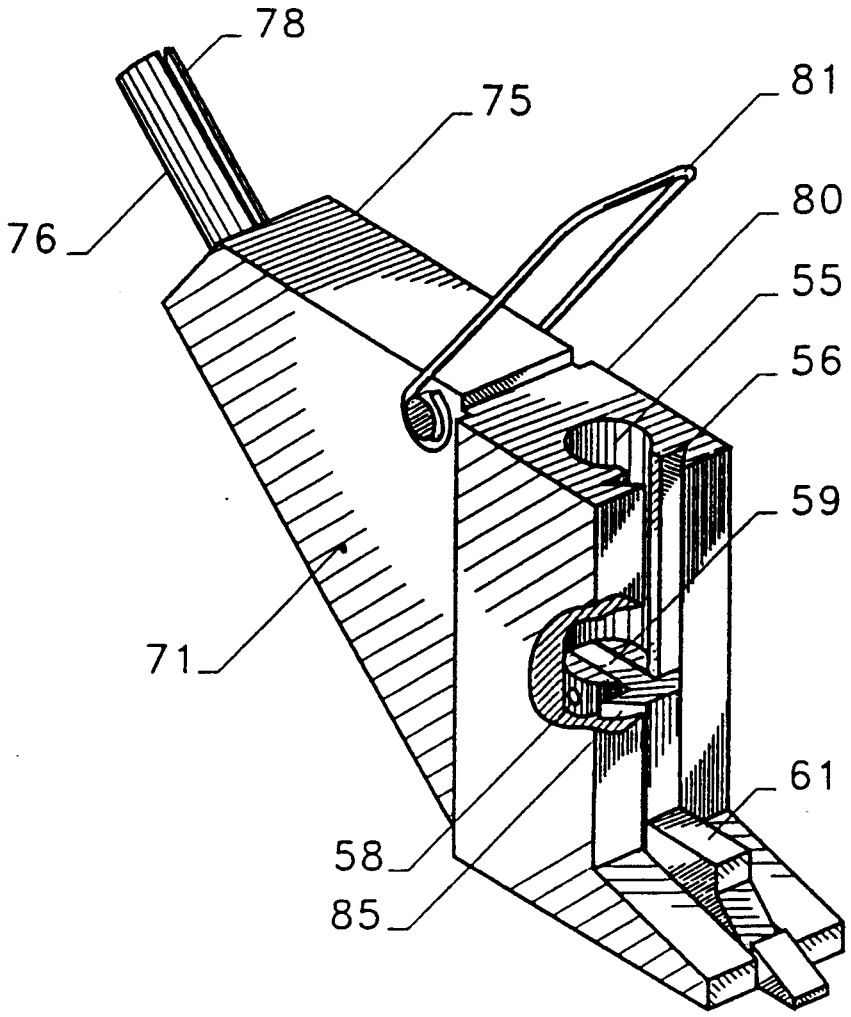

A slice-cleaning apparatus 79, shown in section in FIG. 3, and in isometric views in FIGS. 4 and 5, is inserted within the slice which includes of an upper lip 62 and a lower lip 63. The cleaning apparatus 79 includes a scraping body 61 which is attached to a piston 60 and is biased against the upper lip 62. The scraping body 61 is preferably a corrosion-resistant, low-friction polymer, shaped to conform to the outer surface of the upper lip 62.

The scraping body 61 is preferably shaped to have an inclined edge 64 and a stop edge 66 separated by a surface 65 which conforms to a portion of the outer surface of the upper lip 62. The scraping body 61 is attached to the piston 60 by pin 58 which traverses two upper extensions 57 of the piston 60 and the extended neck 59 of the scraping body 61. The scraping body 61 is provided with two vertical prismatic shaped extensions 85, one on each side (most clearly seen in FIG. 5), which are shaped to conform to and fit closely but slidably within vertical dovetail slots 56 in body 80 of the slice-cleaning apparatus 79. This close fit of prismatic extensions 85 in vertical dovetail slots 56 prevents any rotation of scraping body 61, while permitting sliding vertical motion.

Piston 60 is generally cylindrical in shape, and slides vertically within a cylindrical cavity 55 in the body 80. Piston 60 is sealed by 0-ring 67 so that pressure or suction applied at the lower end of cylindrical cavity 55 results in an upward or downward force on piston 60, which is transmitted to scraping body 61 by pin 58.

Body 80 of the slice-cleaning apparatus 79 has also within it another cylindrical cavity 73 which is inclined and communicates at its lower end through passage 68 with vertical cylindrical cavity 55. Closely fitting within cylindrical cavity 73 is a tube 75 with two grooves on its outer surface which accommodate 0-rings 69. 0-rings 69 seal tube 75 to cylindrical cavity 73 to prevent the escape of air. Tube 75 has slots 72 cut through its wall; the form and function of these slots will be explained later. Tube 75 is locked in place by pin 71 which passes through both sides of body 80 and both walls of tube 75.

Master piston 76 is slidingly located inside tube 75, to which it is sealed by 0-ring 70 at its lower end. Master piston 76 has within it a concentric cylindrical cavity 77, open at the upper end, and extending near to the lower end of master piston 76. Master piston 76 has slots 78 and 74 cut through its wall; the form and function of these slots will be explained later. Pin 71 passes through slots 74 and thereby constrains the movement of master piston 76 within tube 75, and also prevents master piston 76 from being removed from within tube 75.

Locating handle 84 slidingly engages within the cylindrical cavity 77. The two ends of cross pin 83 at the lower end of locating handle 84 enter slots 78 in master piston 76 and also slots 72 in tube 75. How this occurs is explained in more detail below. The length of cross pin 83 is slightly less than the diameter of cylindrical cavity 73 in body 80, so the ends of cross pin 83 will not contact body 80. The engagement of the ends of cross pin 83 within slots 78 allows the person using the slice cleaning apparatus, by means of locating handle 84 to rotate master piston 76, or push it in to cylindrical cavity 77, or pull it and slide it outwardly from cylindrical cavity 77 within the limits imposed by slots 74 and pin 71 as further explained below.

Figure 6:
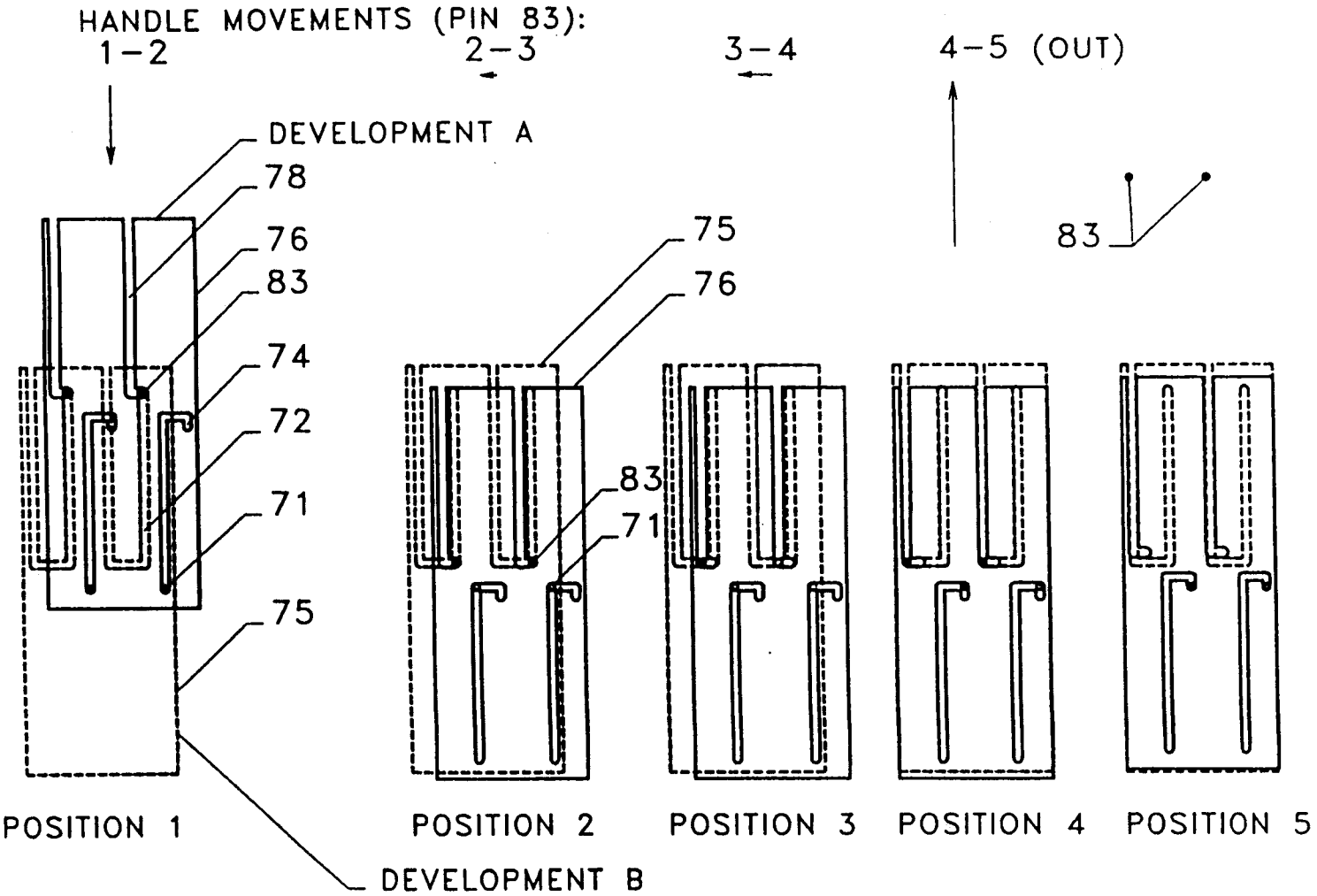
FIG. 6 is a series of developments illustrating diagrammatically the operation of the embodiment of FIG. 3.
Figure 7:
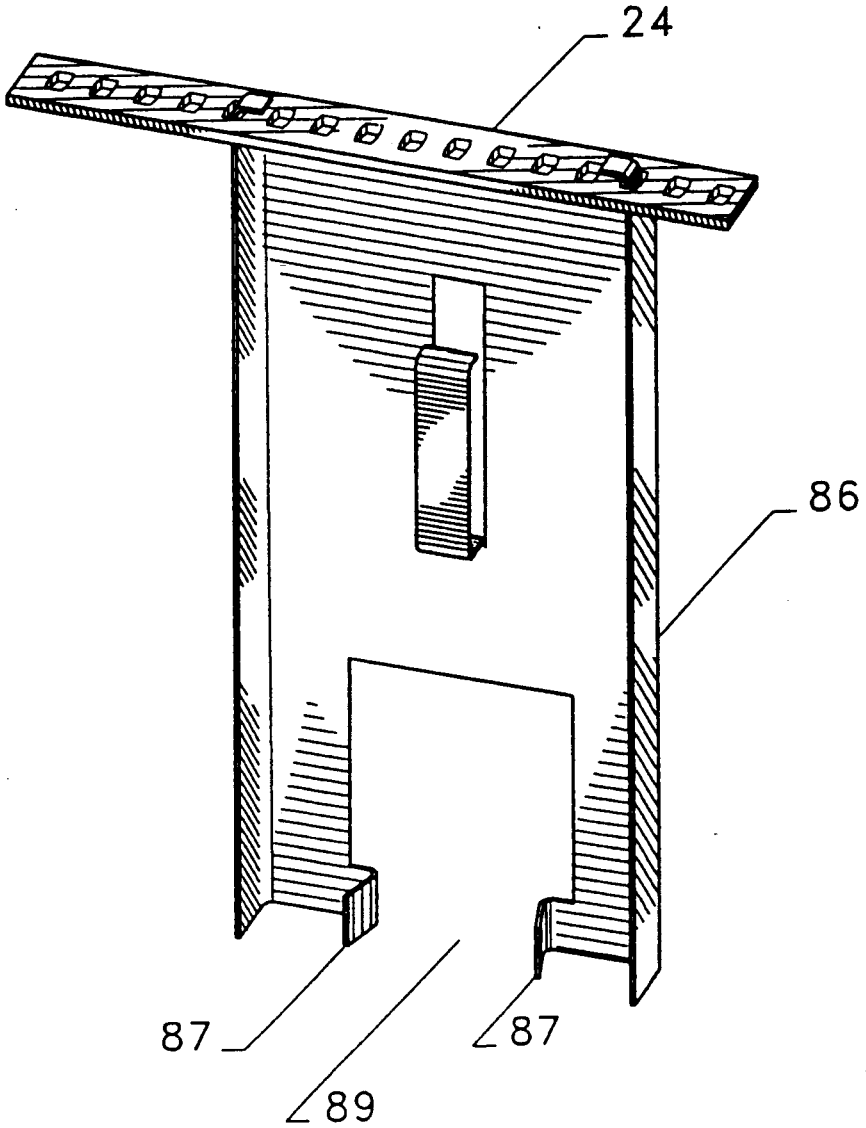
FIG. 7 is a view in perspective of the support carriage of the embodiment of FIG. 3.

Slots 72 in tube 75, slots 78 and 74 in master piston 76, pin 71 in body 80, and cross pin 83 in locating handle 84 interact to constrain the movement of master piston 76 within tube 75 and the interaction with locating handle 84. FIG. 6 demonstrates these movements and interactions.

In FIG. 6, development A shows the inside surface of master piston 76 unrolled to a flat shape. The two "L"-shaped slots 78 are actually 180 degrees opposite each other in master piston 76; similarly with the two hook-shaped slots 74. Development B (in dashed outline) shows the inside surface of tube 75, with slots 72, similarly unrolled to a flat shape. Cross pin 83 in locating handle 84 passes axially both through slots 78 in master piston 76 and slots 72 in tube 75. Pin 71 passes axially both through round holes in tube 75 and slots 74 in master piston 76. (Pin 71 also passes through round holes in body 80, thereby locking tube 75 in place.)

Position 1 in FIG. 6 shows master piston 76 fully extended (pin 71 is at the lower end of slots 74). Cross pin 83 in locating handle 84 is trapped by being engaged simultaneously in slots 78 in master piston 76 and slots 72 in tube 75. Locating handle 84 is thus trapped within master piston 76 and will not easily slip out. In this position the entire slice-cleaning apparatus can be transported by means of locating handle 84.

When it is desired to insert the slice-cleaning apparatus within the slice opening, it is carried to the desired location by means of locating handle 84. The carriage 86 (described later) is positioned at the desired location. By means of locating handle 84 slice-cleaning apparatus 79 is presented to the slice opening, between lips 87 of carriage 86 (FIG. 4), and scraping body 61 is inserted into the slice opening. When stop edge 66 of scraping body 61 (FIG. 3) contacts the exterior face of slice upper lip 62, scraping body 61 can enter no further into the slice opening. By applying axial force to locating handle 84, master piston 76 is pushed into tube 75, the force being transmitted from locating handle 84 to master piston 76 by means of cross pin 83. This axial movement is the only movement allowed, and is permitted by the displacement of cross pin 83 along part of slots 72 in tube 75, and also the displacement of slots 74 in master piston 76 over (stationary) pin 71. At the end of this axial movement, the relative positions of master piston 76, tube 75, cross pin 83 and pin 71 are as shown in Position 2 of FIG. 6.

After locating handle 84 is pushed in as far as it will go, (as shown in Position 2 of FIG. 6), it is rotated; the rotation will be described in two stages, although in practice the rotation will be one continuous movement. In the first stage, locating handle 84 is rotated so as to cause cross pin 83 to move to the other end of the short section of "L"-shaped slots 78 in master piston 76; master piston 76 itself does not move. This stage is illustrated in Position 3 of FIG. 6. Further rotation of locating handle 84 transmits rotation to master piston 76 due to its contact with cross pin 83. Rotation of master piston 76 is possible because the previous axial displacement of master piston 76 has aligned the transverse (actually, circumferential) portion of slots 74 with pin 71. Rotation is limited by cross pin 83 reaching the end of the transverse portion of slots 72 in tube 75, and simultaneously the end of the transverse portion of slots 74 in master piston 76 coming up against pin 71. At the end of this second stage of rotation, the situation is as illustrated in Position 4 of FIG. 6.

After this rotation, locating handle 84 with cross pin 83 is withdrawn axially out of master piston 76. The air compressed by the inward motion of master piston 76 between Position 1 and Position 2 reacts with an outward force against master piston 76, and when the force applied by means of locating handle 84 and cross pin 83 is withdrawn, this outward force pushes master piston 76 outward until the "hook" at the end of each slot 74 is fully engaged against pin 71. In this manner pin 71 prevents master piston 76 from moving outward any further. The air compressed by master piston 76 passes through passage 68 into cylindrical cavity 55 under piston 60, exerting an upward force on piston 60 which is transmitted by means of pin 58 to scraping body 61. Scraping body 61 moves upwardly until it meets the edge of the slice upper lip 62. The compressed air then operates as a gas spring to bias the scraping body against the slice upper lip 62. The bottom of body 80 operates as the foot seating against the lower lip 63.

Further upward motion is prevented, but the residual pressure trapped under piston 60 continues to exert an upward force, ensuring full contact of scraping body 61 with upper lip 62 even if the slice opening should vary. With the scraping body properly engaged in this manner, and the locating handle withdrawn, power may be engaged to drive carriage 86 and thereby the slice-cleaning apparatus laterally as described before.

After the slice-cleaning operation is completed, the slice-cleaning apparatus 79 is removed from the slice area by inserting locating handle 84 into master piston 76, cross pin 83 engaging in slots 78, and reversing the sequence of axial and rotary movements described above. On pulling outwardly on master piston 76 to move it from Position 2 of FIG. 6 to Position 1, suction is generated at the lower end of master piston 76, which is communicated to piston 60 and positively pulls scraping body 61 downwardly away from the slice upper lip 62. On disengagement of scraping body 61 from slice upper lip 62, slice-cleaning apparatus 79 may be withdrawn from the area.

Slice-cleaning apparatus 79 is traversed by pin 88 (see FIG. 4), which protrudes on each side of body 80. Wire loop 81 pivots freely on pin 88. Before slice-cleaning apparatus 79 is engaged with carriage 86, wire loop 81 is positioned to rest on the forward part of body 80, pointing away from locating handle 84. Before inserting slice-cleaning apparatus 79 between lips 87, it is manipulated so wire loop 81 engages on hook 82 on carriage 86. Wire loop 81 may move freely within the confines of hook 82; the purpose of its engagement is to prevent the slice-cleaning apparatus from being carried away if by accident scraping body 61 should become disengaged from slice upper lip 62. On removal of the slice-cleaning apparatus, wire loop 81 is disengaged from hook 82 by lifting it out through the restricted opening at the upper end of hook 82.

The upper part of carriage 86 is identical with that of carriage 26 in the embodiment described previously. The lower part is described with reference to FIG. 7. The lower part of carriage 86 has an open, downwardly-facing slot 89, bordered by two lips 87. Lips 87 diverge from each other to make it easier to insert the slice-cleaning apparatus between them. The space between lips 87 at their closest approach is slightly larger than the width of body 80 of slice-cleaning apparatus 79, to allow easy insertion. When carriage 86 is driven laterally by operation of drive apparatus 22 (as described previously), lips 87 push on the side of slice-cleaning apparatus 79, forcing it to slide laterally along the slice in a similar fashion to that shown for the previously-described embodiment.

One of the key elements of the present invention is the scraping body which conforms to the shape of the upper, typically sharp-edged, plate or lip of the slice. This scraping body is a block of a corrosion resistant, low friction polymer, such as high density polyethylene or acetal in the preferred embodiment. It is possible, however, to create a broad variety of structures for use as a "scraping body" which, when driven along the surface of the upper lip of the slice, would serve the same purpose as the preferred scraping body. For example, a series of sharp blades may be aligned with and seated against the outer surface of the upper lip.

Another key element of the invention is a bias means for urging the aforementioned scraping body up into contact with the lip. This bias means allows for insertion and removal of the scraping body without disassembling the cleaning apparatus as would be required with some type of screw thread design. The bias means of the preferred embodiment, which is a generally U-shaped spring, may be compressed by hand, thereby allowing for easy insertion and removal of the cleaning apparatus. Another alternative bias means would be compressed air, as illustrated in FIGS. 3–7, which would be more appropriate in larger paper machines.

A third key element of the present invention is a foot which rests against the lower plate or lip of the slice and which is attached to the bias means at the opposite end as the scraping body. This foot in the preferred embodiment is a corrosion resistant, low friction polymer of a similar material to that used for the scraping body which allows the foot to slide easily along the lower lip. The foot may, however, be substituted with some type of wheel or bearing assembly.

The described cleaning apparatus may be pulled along the slice by any suitable device known in the art for driving a body in motion. If the slice is not as accessible as illustrated in FIGS. 1 and 2, the cleaning apparatus may be pulled along the length of the slice opening by a cord which may be wrapped around a simple pulley driven by a motor or may be pulled along by hand. However, the preferred embodiment of the present invention uses an electric motor having a sprocket on its drive shaft, the sprocket teeth engaging with a closed loop transmission belt (a thin, wide belt with square holes in its which attaches, via a complex linking apparatus, to the cleaning apparatus.

While certain preferred embodiments of the present invention have been disclosed in detail, it is to be understood that various modifications may be adopted without departing from the spirit of the invention or scope of the following claims.

We claim:

1. In a paper manufacturing machine including a slice having, in an operable position, an upper lip and a lower lip between which a suspension of paper fibers and other materials in water flows, an improved slice cleaning apparatus comprising:

(a) a scraping body, which matingly conforms to at least a portion of the upper lip;

(b) a foot which seats against the lower lip; and (c) a bias means which connects the scraping body with the foot for urging the scraping body against the upper lip.

2. The slice cleaning apparatus in accordance with claim 1 wherein the scraping body comprises a block which matingly conforms to the upper lip.

3. The slice cleaning apparatus in accordance with claim 1 further comprising a means for compressing the bias means for insertion and removal of the slice cleaning apparatus.

4. The slice cleaning apparatus in accordance with claim 1 wherein the scraping body is made of a corrosion resistant, low friction polymer.

5. The slice cleaning apparatus in accordance with claim 3 wherein the compressing means is hand grippable and manually compressible.

6. The slice cleaning apparatus in accordance with claim 5 wherein a generally U-shaped leaf spring attached at one end to the scraping body and at the opposite end to the foot forms both the bias means and the compressing means.

7. The slice cleaning apparatus in accordance with claim 6 comprising means for movably mounting the scraping body to the bias means to allow three-dimensional pivotal movement of the scraping body relative to the bias means.

8. The slice cleaning apparatus in accordance with claim 1 or 2 or 3 or 4 or 5 or 6 further comprising a drive: means, drivingly linked to the slice cleaning apparatus for driving the slice cleaning apparatus laterally along the slice surfaces for removing undesirable accumulations.

9. The slice cleaning apparatus in accordance with claim 8 wherein the drive means comprises:

(a) a carriage, extending downwardly from a driving mechanism and having a pair of ears extending outwardly from opposite side edges;

(b) a linking body having a pair of side panels extending transverse to the plane of the linking body;

(c) at least one pair of slots formed in each side panel into which the ears of the carriage are inserted; and (d) a neck extending downwardly from the linking body and pivotally mounting to the slice cleaning apparatus.

10. The slice cleaning apparatus in accordance with claim 9, wherein each side panel of the linking body has two slots transverse to each other and a circular enlargement of the slots at the intersection of the slots, for insertion of the ear of the carriage into the first slot, pivoting of the linking body about the ear when the ear reaches the circular enlargement at the intersection of the two slots, and sliding of the linking body down the second slot.

11. The slice cleaning apparatus in accordance with claim 9 comprising means for movably connecting the scraping body to the bias means to allow three-dimensional movement of the scraping body relative to the bias means.

12. The slice cleaning apparatus in accordance with claim 11 wherein the scraping body is made of a corrosion resistant, low friction polymer.

13. The slice cleaning apparatus in accordance with claim 11 wherein the scraping body further comprises at least one blade.

14. The slice cleaning apparatus in accordance with claim 1 wherein the bias means more particularly comprises a gas spring having a gas compressing means for selectively increasing and decreasing the pressure of the gas of the gas spring.

15. For use in a paper manufacturing machine including a slice having, in an operable position, an upper lip and a lower lip between which a suspension of paper fibers and other materials in water flows, an improved slice cleaning method comprising:

(a) forming a scraping body to matingly conform to the upper lip;

(b) forming a foot which seats against the lower lip;

(c) biasing the body upwardly against the upper lip by using the foot for urging the body against the upper lip; and (d) driving the body laterally over the slice for removing any undesirable particles.

16. The method of claim 14 wherein the biasing force is also applied against the lower lip of the slice.

* * * * *